United States Patent [19]

Hawke

[11] 3,955,818

[45] May 11, 1976

[54] BOARD GAME APPARATUS

[76] Inventor: Thomas A. Hawke, 3133 Vernon, Brookfield, Ill. 60513

[22] Filed: June 12, 1974

[21] Appl. No.: 469,274

[52] U.S. Cl. ..... 273/134 AC; 273/134 C; 273/134 D

[51] Int. Cl.[2] ..... A63F 3/00

[58] Field of Search ..... 273/131, 134

[56] References Cited

UNITED STATES PATENTS

| | | | |
|---|---|---|---|
| 2,165,891 | 7/1939 | Freedman | 273/134 C |

FOREIGN PATENTS OR APPLICATIONS

| | | | |
|---|---|---|---|
| 586,817 | 4/1947 | United Kingdom | 273/134 C |
| 1,261,391 | 4/1961 | France | 273/134 AD |
| 1,261,392 | 4/1961 | France | 273/134 AD |

OTHER PUBLICATIONS

Playthings, Apr. 1959, p. 3.
Playthings, May 1959, p. 1.

*Primary Examiner*—Delbert B. Lowe
*Attorney, Agent, or Firm*—Bernard L. Kleinke

[57] ABSTRACT

A diplomatic assassination game includes an assassination indicia on at least one of the subdivisions interconnecting smaller areas of a larger playing area on a game board, playing cards having assassination indicia on the faces of certain ones thereof and others having the faces thereof blank so that each one of the players of the game may use at least one assassination indicia bearing card and at least one blank card for playing purposes, placing face down in a group or pile one playing card from each one of the players of the game in response to the player's position-marking piece being moved to a subdivision bearing the assassination indicia in accordance with move determining dice. The occurrence of an assassination is designated when one of the playing cards bears the assassination indicia thereon so that an investigation may then be commenced to determine which one of the remaining pieces is associated with the card bearing the assassination indicia.

8 Claims, 8 Drawing Figures

Fig. 2.

49

MASTER PLAN

| CITY | WEAPON | MONEY |
|---|---|---|
| CHICAGO | BOMB<br>AIRPLANE CRASH | $ 30,000<br>$ 70,000 |
| DALLAS | RIFLE<br>ELECTROCUTION<br>ELEVATOR MALFUNCTION | $ 25,000<br>$ 40,000<br>$ 60,000 |
| KANSAS CITY | POISON GAS<br>BURNING | $ 35,000<br>$ 75,000 |
| LOS ANGELES | PISTOL<br>RAILROAD DERAILMENT<br>AIRPLANE CRASH | $ 35,000<br>$ 80,000<br>$ 70,000 |
| MIAMI | BOAT ACCIDENT<br>ELEVATOR MALFUNCTION | $ 40,000<br>$ 60,000 |
| NEW ORLEANS | CAR SABATOGE<br>BURNING | $ 35,000<br>$ 75,000 |
| NEW YORK | POISON GAS<br>BURNING | $ 35,000<br>$ 75,000 |
| SEATTLE | BOAT ACCIDENT<br>ELEVATOR MALFUNCTION | $ 40,000<br>$ 60,000 |
| WASHINGTON D. C. | BOMB<br>STRANGULATION<br>POISONED DRINK | $ 30,000<br>$ 40,000<br>$ 75,000 |

Fig. 3.

SQUARES ON BOARD

| | | | |
|---|---|---|---|
| DMC | DIPLOMATIC MOVEMENT | + | ALIBI |
| AMC | ASSASSIN MOVEMENT | × | ASSASSINATION |
| W | WEAPON | TAKE | TAKE CARD FROM OTHER PLAYER |
| $ | MONEY | ? | QUESTION |

Fig. 11

51

| ASSASSIN MOVEMENT CHART | CHICAGO | DALLAS | KANSAS CITY | LOS ANGELES | MIAMI | NEW ORLEANS | NEW YORK | SEATTLE | WASHINGTON D.C. |
|---|---|---|---|---|---|---|---|---|---|
| FOREIGN POWER | | | | | | | | | |
| INDUSTRIAL BARONS | | | | | | | | | |
| ORGANIZED CRIME | | | | | | | | | |
| RIGHT WING CITIZENS | | | | | | | | | |
| DIPOLMAT | | | | | | | | | |

| ASSASSIN ALIBI CHART | CHICAGO | DALLAS | KANSAS CITY | LOS ANGELES | MIAMI | NEW ORLEANS | NEW YORK | SEATTLE | WASHINGTON D.C. | WILD CARD |
|---|---|---|---|---|---|---|---|---|---|---|
| FOREIGN POWER | | | | | | | | | | |
| INDUSTRIAL BARONS | | | | | | | | | | |
| ORGANIZED CRIME | | | | | | | | | | |
| RIGHT WING CITIZENS | | | | | | | | | | |

| ASSASSIN WEAPON CHART | AIRPLANE CRASH | BOAT ACCIDENT | BOMB | BURNING | CAR SABATOGE | ELECTROCUTION | ELEVATOR MALFUNCTION | PISTOL | POISONED DRINK | POISON GAS | RIFLE | STRANGULATION | TRAIN DERAILMENT |
|---|---|---|---|---|---|---|---|---|---|---|---|---|---|
| FOREIGN POWER | | | | | | | | | | | | | |
| INDUSTRIAL BARONS | | | | | | | | | | | | | |
| ORGANIZED CRIME | | | | | | | | | | | | | |
| RIGHT WING CITIZENS | | | | | | | | | | | | | |
| DECLARATION OF ASSASSINATION | CITY | | | | WEAPON | | | | | | MONEY | | |

53

| ASSASSIN MONEY CHART | $5,000 | $10,000 | $15,000 | $20,000 | $50,000 |
|---|---|---|---|---|---|
| FOREIGN POWER | | | | | |
| INDUSTRIAL BARONS | | | | | |
| ORGANIZED CRIME | | | | | |
| RIGHT WING CITIZENS | | | | | |

PLOT CHART

BOARD GAME APPARATUS

The present invention relates to a game, and it more particularly relates to a board game, which includes a game board, playing cards, position marking pieces and move-determining means.

Board games, such as the one disclosed in British Pat. specification 586,817 and sold under the name "CLUE", have been quite popular and have been entertaining to play. The game disclosed in the British patent specification employs game apparatus enabling the players to arrive by individual deduction and as a result of information accumulating during play at a correct identification of any particular hidden combination of three cards out of a large number of such possible combinations. The three cards are selected at random at the beginning of the game to determine which one of the characters associated with each one of the players has been murdered, with what weapon and in which room of a house depicted on the game board of the game apparatus. Thus, by certain deductions made during the course of play, the players try to determine the identity of the three cards selected at the beginning of the game. While such a game is entertaining, it would be highly desirable to have board game apparatus which is more complex in format and requires more strategy for the players. In this regard, it would be highly desirable to have board game apparatus which enables the players to cause an "assassination" to occur of a mythical diplomat, and then have the play of the game continue to determine which one of the players committed the assassination.

The principal object of the present invention is to provide a new and improved game.

Another object of the present invention is to provide a new and improved game which provides an intellectually challenging and highly entertaining board game in which the object of the game is to assassinate a mythical diplomat in an undetected imaginary manner by one of the players who qualifies to perform such an imaginary act as a result of his information gained during play.

Briefly, the above and further objects are realized in accordance with the present invention by providing a game board having a flat playing area containing smaller areas and subdivisions interconnecting the smaller areas and providing an assassination indicia on at least one of the subdivisions of the board. Playing cards are also provided, and the faces of certain ones of the playing cards are provided with assassination indicia, with other ones of the cards having blank faces so that each one of the players of the game may use at least one assassination indicia bearing card and at least one blank card for playing purposes. During playing of the game, each player places face down one playing card in response to a position-marking piece being moved to a subdivision bearing the assassination indicia in accordance with a move determining device. The occurrence of an assassination is designated or determined when one of the playing cards bears the assassination indicia thereon. Subsequent thereto, an investigation is performed by the players to determine which one of the pieces is associated with the card bearing the assassination indicia.

These and other important objects and advantages of the invention will be more fully understood upon a reading of the following specification taken in view of the attached drawings, wherein:

FIG. 2 is a master plan chart used in the game of the present invention;

FIG. 3 is a table explaining the indicia on the subdivisions of the map of FIG. 1;

FIG. 4 is a plot chart used in the game of the present invention;

Figure 1:
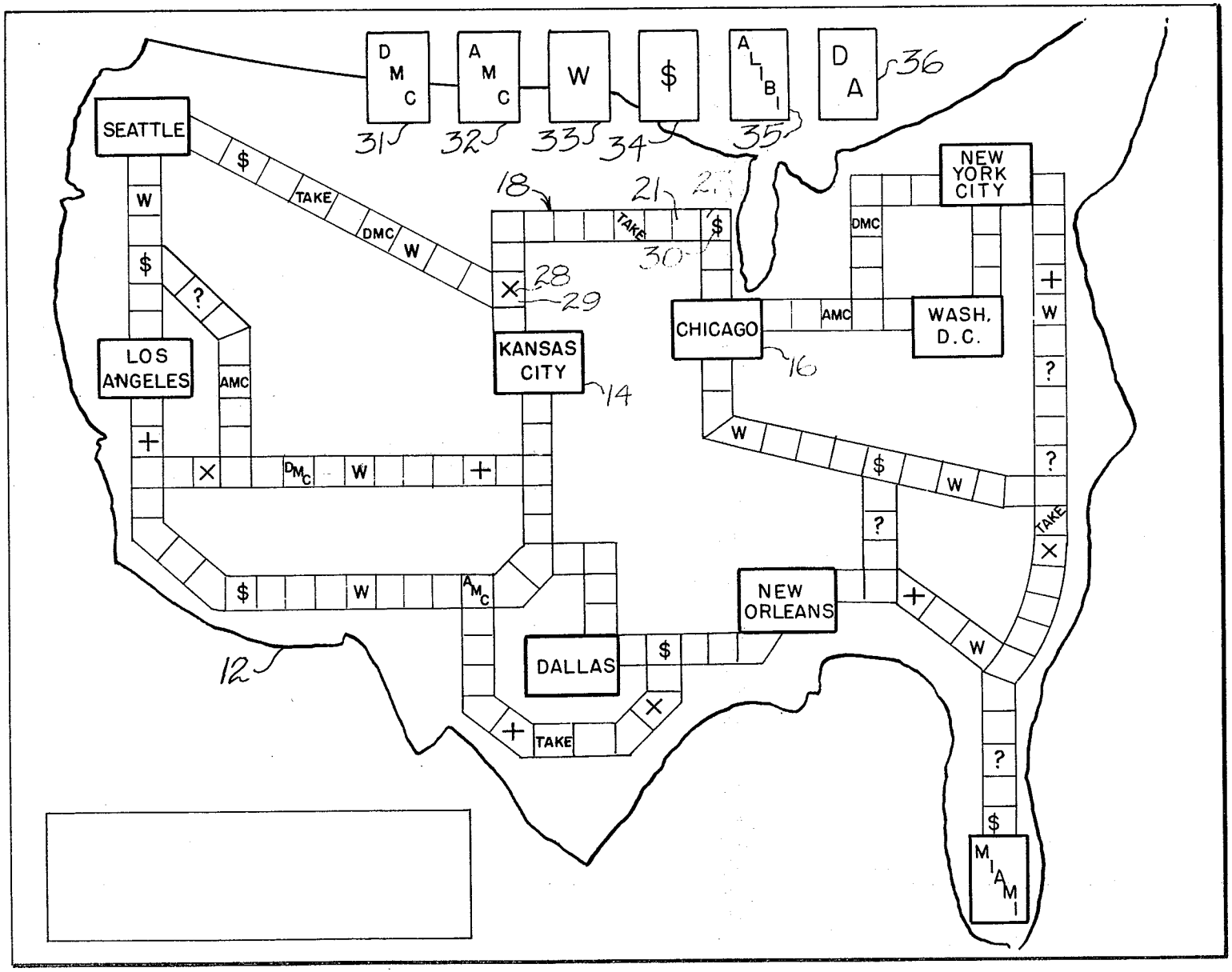
FIG. 1 is a plan view of a game board of the present invention.

Referring now to the drawings, and more particularly to FIG. 1 thereof, there is shown a game board 10, which is constructed in accordance with the present invention and which is used in accordance with the method of the present invention.

Figure 5:
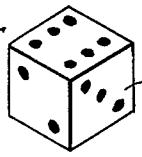
FIG. 5 is a pictorial view of one of the move determining devices in the form of a die.
Figure 6:
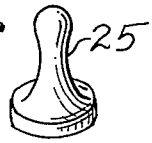
FIG. 6 is a pictorial view of one of the position-marking pieces representing the mythical diplomat for the board of FIG. 1.
Figure 7:
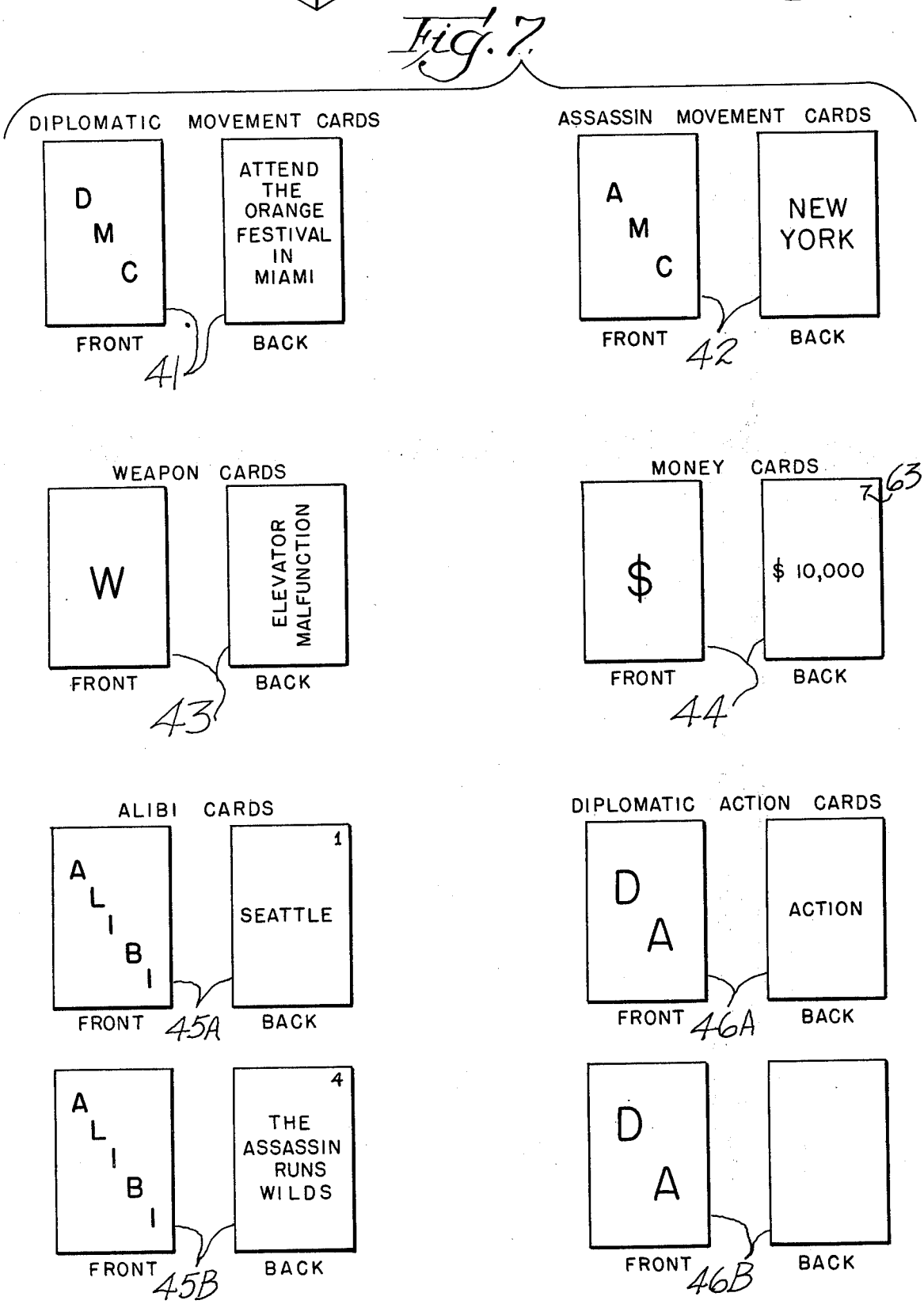
FIG. 7 illustrates the front and back sides of representative ones of the playing cards used in the game of the present invention.
Figure 6A:
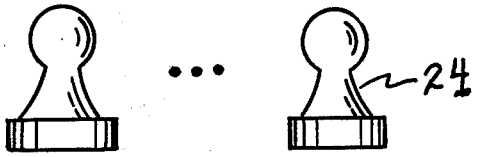
FIG. 6A is an elevational view of the other ones of the position-marking pieces for the players of the game.

The board 10 has on its face a playing area 12 in the shape of the outline of a map of a country, such as the United States, and within the playing area 12 a series of smaller areas, such as the areas 14 and 16, represent cities within the country. A plurality of paths, such as the path 18 extending between the Chicago smaller area 16 and the Kansas City smaller area 14, are divided into squares or subdivisions, such as the squares 21 and 23 of the path 18. As shown in FIG. 6A, a plurality of movable position-marking pieces, such as the piece 24, are distributed among the players of the game and are distinguishable from one another by their color, the pieces being movable from one to another of the smaller areas or cities along the subdivisions. As shown in FIG. 5, move determining means in the form of a die 27 ascertain at random the number of moves of the pieces along the subdivisions of the map-shaped playing area 12 on the board 10. An additional position marking piece or pawn 25 of FIG. 6 serves to represent a mythical diplomat and is moved about the playing area as hereinafter described in greater detail, the object of the game being to perform an imaginary assassination of the diplomat. A plurality of letter X indicia, such as a letter X indicia 28 of subdivision 29 of path 18, designate that an assassination attempt is to take place, and if an assassination occurs as hereinafter described in greater detail, then an investigation phase of the game follows during which the player who committed the assassination attempts to conceal his identity and the other players try to identify the assassin and how the assassination occurred. If the player who committed the assassination successfully conceals his identity, he wins the game, but conversely, if one of the other players correctly identifies the player who committed the assassination and determines the manner in which the assassination occurred, then such accusing player wins the game. Other indicia, such as a dollar sign ($) 30 of subdivision 23, indicate when a piece or pawn lands thereon that the card position areas 31 through 36 are to be referred to for drawing the top card of one of six decks of playing cards 41 through 46 of FIG. 7, which shows representative ones of the cards of each deck of playing cards resting on the board 10 within the corresponding card position areas 31 through 36 on the face of the board 10. The table of FIG. 3 provides an explanation of the indicia on each square or subdivision of the board 10 as hereinafter described in greater detail. A master plan card 49 is provided to indicate the necessary requirements for assassinating the diplomat, and in this regard, a player is eligible to assassinate the diplomat when the diplomat has moved through a given city and the necessary weapon and money playing cards as indicated on the master plan chart as hereinafter described in greater detail have been acquired by the player. As shown in FIG. 4, each one of the players is provided with a plot chart, such as the plot chart 51, so that the players can make a record of the various different movements of opposing players, since a further requirement to commit an assassination is that the player committing the assassination must have moved to one of the smaller city areas such as the area 14. As shown on the plot chart 51, each one of the pawns, such as the pawn 24, represents an organization, such as the "foreign power" organization.

In accordance with the method of the present invention, the game is played in two separate phases. During phase I, or the assassination phase, the players move their pieces, such as the piece or pawn 24, along the paths interconnecting the city areas of the board 10 in accordance with the rolling of the die 27 of FIG. 5. As hereinafter described in greater detail, the players each acquire different cards as they move along the paths on the face of the board 10 with their pawns, and once a player has fulfilled all of the requirements for assassinating the diplomat as hereinafter described in greater detail, and once an opposing player's pawn lands on an X subdivision or square, an attempted assassination is designated. In this regard, each one of the players places a diplomatic action card back side down and then all of the cards are shuffled. If one of the cards then bears the word "ACTION", then an assassination has occurred. Thereafter, an investigation phase takes place as hereinafter described in greater detail.

Considering now the method of playing the game of the present invention in greater detail, the player who assassinates the diplomat wins the game if he can conceal his identity from the rest of the players. As an investigator, a player wins the game if he identifies the assassin, the city of assassination, the weapon used, and the financing of the assassination within the time limit.

The master plan chart 49 indicates which weapons and money amounts are needed to assassinate in each city.

Each player records his movements and those of opposing players from city to city on his plot chart, such as the chart 51. Also, the movements of the diplomat pawn are recorded by marking thereon with a suitable writing instrument (not shown). During the investigation phase the plot chart is used to record the weapon cards 43, alibi cards 45, and money cards 44 of opposing players. The assassinating player records the place of assassination, weapon used, and money amount in a box or area 53 of his plot chart.

Cards

There are 23 money cards 44 in denominations of $5,000, $10,000, $15,000, $20,000, and $50,000 which are placed face down on the board at the beginning of the game. The total value of all money cards is $300,000.

There are 13 weapon cards 43 placed face down over the area 33 on the board. They are as follows: Airplane Crash, Boat Accident, Bomb, Burning, Electrocution, Elevator Malfunction, Pistol, Poisoned Drink, Poison Gas, Rifle, Sabatoge of Car, Strangulation, and Train Derailment.

There are 20 alibi cards 45 placed face down over the area 35 on the board. There are two alibi cards for each city plus two wild cards that can be used as an alibi in any city.

There are 18 assassin movement cards 42 placed face down on the board. Each has the name of a city on it and some have added instructions on them. When drawing these cards the player moves his pawn to the city named on the card and follows the further instructions, if there are any. In this regard, instructions may be provided on some of these cards, if desired.

There are 18 diplomatic movement cards 41 placed face down on the board. When one is drawn the diplomat pawn is moved to the stated city. This is the only way the diplomat pawn may be moved. However, if a card reads Secret Service Protection along with the name of the city he is to be moved to, the diplomat is immune to assassination while in that city and cannot be assassinated until he has been moved to another city by a drawing of a card.

Each player receives 2 of diplomatic action cards 46. One is blank on the reverse or back side and the other states ACTION. These cards are used to declare an assassination.

Playing Board

Considering now the board 10 of FIG. 1 and the table of FIG. 3, a player landing on $ square is entitled to take a money card from the deck.

A player landing on a W or weapon card square is entitled to take a weapon card from the deck.

A player landing on an alibi or + square may either (1) draw an alibi card from the deck of (2) take an alibi card from an opposing player. During the investigation phase a player landing on this square may see an alibi card of an opposing player.

A player landing on a take square can take one card (weapon, alibi, or money) from an opposing player.

A player landing on an assassin movement square AMC must take a card from the assassin movement card deck and follow the instructions.

A player landing on diplomatic movement DMC square draws a card from the diplomatic movement card deck and moves the diplomat to the city stated thereon.

When a player lands on an X action square all players place on the table a diplomatic action card.

A question (?) square is used only during the investigation phase. When a pawn lands on this square the player can ask to see a card (weapon, alibi, or money) of an opposing player.

Weapon and money squares are not used when all such cards have been taken from the weapon and money card decks on the board and none of such cards remain on the board. Weapon and money squares also become unusable during the investigation phase.

Cities

There are nine cities on the board as designated with the smaller areas. At the beginning of the game each player starts with his pawn positioned within the smaller area assigned as his home city. They are as follows:

| PLAYER | HOME CITY |
|---|---|
| Foreign Power | Los Angeles |
| Industrial Barons | New York |
| Organized Crime | Chicago |
| Right Wing Citizens | Miami |

A player's pawn must move to his home city sometime later in the game after initially moving it therefrom as determined at random by the dice before the player can become eligible to "assassinate" the diplomat at such a home city.

In general, the players move their pawn along the playing area 12 of the board 10 and travel from city to city by the throw of dice. A player passing through a city has the option of stopping there or continuing through that city. If he stops he receives credit for the city, but if he continues through he does not receive credit for it. A player does not have to land in a city on the exact throw of the dice. He needs only the number to reach the city. Once a player moves his pawn to a city he may leave the city by the exit of his choice. This is the only time a player may move his pawn backwards. All other movement is forward.

Game Play

To start the game each player picks an organization of assassination to represent and places his pawn in the proper home city. The diplomat pawn is then moved via a diplomatic movement card to the city called for by a free draw of the DMC cards. Players then roll the dice to determine the order of play, the highest number going first and following turns revolving from his left. Each player receives two diplomatic action cards, one blank and one bearing the word ACTION.

During phase 1 (assassination phase), the movement of pawns commences by the shake of the dice. To move, the player rolls two dice, the other die not being shown in the drawings. He may then move the number of squares indicated on either one of the dice, but not the total number of both dice. Each player moves his pawn about the board from city to city gaining credit for them. Players also acquire weapons, alibis, and money for use in the assassination by moving their pawns to the various squares or subdivisions, and taking the proper cards dictated by the squares.

During this phase one player may bump the pawn of another player as hereinafter described in greater detail.

Assassination can only occur when a player moves his pawn to an X square. At this time each player places one of his diplomatic assassination cards face down in the middle of the board. If a player wishes to and is able to "assassinate" the diplomat in accordance with the rules for playing the game, he places his card bearing the word "ACTION" down on the board with the word "ACTION" concealed from the view of the other players. The cards are shuffled and turned back face up. If there is an action card showing the word ACTION, the diplomat has been assassinated. If all cards are blank the cards are returned to the players and the game commences. If there is more than one action card showing, all remaining diplomatic action cards are collected from the players face down and returned to each player, each receiving one blank card and one action card as before. There can be no assassination if more than one action card shows as there can be only one assassin. The game then continues until at a later time only one action card appears.

Once the diplomat has been assassinated, the assassination phase has been completed, and phase 2, the investigation phase, begins immediately.

During phase 2, all players participate, including the assassin, who tries to conceal his identity from the other players. All squares become void and unusable with the exception of ? squares and + squares. All cards remaining on the board remain face down and are no longer used.

When a player moves his pawn to a ? square, he may acquire information by seeing a weapon, alibi, or money card for an opposing player without permitting the other players to see the exposed card. He then records this information upon his plot chart, noting a key card number, such as the number indicia 63 on the money card 44 of FIG. 7.

When a player's pawn lands on a + square he may see an alibi card of an opposing player. When a player's pawn lands upon the same space as another player or players, he may see a weapon, alibi, or money card of one or all of the players on that square.

Once a player feels he has enough information to accuse an assassin, he must either move his pawn to a ? square or to the same space as the player he wishes to accuse. He may then ask to see one last card of that player and then accuse him, stating the city of assassination, the weapon used, and the amount of money used. If the accusation is wrong in any of its parts, the accused player denies it and the accusing player is out of the game so that the game can continue. The withdrawing player shows all of his cards to the remaining players. If the accusation is correct, the assassin must admit it and the accusing player is the winner.

When there are only two players remaining, one the investigator and the other the assassin, the investigator has 10 minutes to continue and to make a valid deduction. If he does, he wins. If he fails, the assassin wins. The assassin can never make an accusation.

Bumping

The act of "bumping" occurs when one player moves his pawn to a square already occupied by another player or players. The bumping player has the option of taking a weapon, alibi, or money card from each player whose pawn rests on that square. Also, if he wishes he may send one or all of the players' pawns back to their home cities.

A bumping player may forfeit the procedure if he wishes to obey the instructions that are on the square upon which his pawn is resting. However, if he does this, he may not bump any other player's pawn on that square.

When a player is bumped back to his home city, he does not receive credit for the city and he cannot bump another player who happens to be in that city at the time. Players may be bumped while in a city. After an assassination, all options of bumping become void.

Key Card Number

Each alibi and money card has a key card number indicia on it to be used during investigation. When shown a card, the investigator records the alibi or money information on his plot chart along with the key card number. If the investigator is shown the same card later, he then may ask to see a card that he has not previously been shown. See indicia 63 of FIG. 7.

Assassination Requirements

To assassinate the diplomat the assassin must be able to meet these requirements:

1. At some point in the game, a player's pawn must have been in and received credit for a city that the diplomat pawn has also occupied. The assassin need not have been in that city at the exact time as the diplomat pawn; he may have been there before or after the diplomat.

2. The player must have in his possession at the time of the assassination one of the weapon cards required by the city he is to assassinate in, the corresponding amount of money called for by that weapon, and the proper alibi cards covering the other city or cities that he could also perform an assassination in.

3. The player must have an alibi card for each city that he can assassinate in but chooses not to do so in that city. If he can assassinate in three cities he must have alibi cards for the two cities he does not perform an assassination in. if he does not have the proper alibi cards, he may not assassinate until he acquires them.

4. The assassin may have in his hands at the time he assassinates more alibi cards than he needs. He may even have an alibi card in his hand for the city that he performs the assassination in. He is not penalized for this act.

5. He must be the only player to throw in an action card after a pawn has landed upon an X square.

6. A player cannot assassinate when the diplomat is under secret service protection and must wait until the diplomat pawn is moved to another city and is without secret service protection.

7. If the potential assassin at any time has the weapon card, alibi card, or money card needed to complete the assassination taken from him by another player before he is able to declare Diplomatic Action he can no longer assassinate and must work to acquire the proper tools of assassination once more before he can assassinate by acquiring the proper cards.

8. An assassin may be able to assassinate in more than one place. However, when he assassinates he must choose only one city, weapon, and money count and mark them in the proper box on his plot chart.

9. If a player has the means to assassinate he is not obligated to do so. It is his choice.

While the present invention has been described in connection with a particular embodiment thereof, it will be understood that those skilled in the art may make many changes and modifications without departing from the invention. For example, the playing area 12 may be in the shape of various different countries of the world, and the smaller areas may represent cities of other countries as well. Also, other pawn move determining means, such as a spinner, may also be employed. Accordingly, it is intended by the appended claims to cover all such changes and modifications as fall within the true spirit and scope of this invention.

What is claimed is:

1. In game apparatus, the improvement comprising:

a game board having a playing area containing smaller areas and paths including subdivisions interconnecting said smaller areas;

a plurality of movable position-marking player pieces distinguishable from one another and movable from one to another of said smaller areas along said subdivisions, said pieces being associated individually with the players of the game and being moved by their associated players;

first move determining means for ascertaining at random the moves of the player pieces along said playing area;

a single movable position-marking object piece distinguishable from each one of said player pieces, said object piece being movable directly from one smaller area to another smaller area by any one of the players;

second move determining means visually distinguishable from and separate from said first move determining means for ascertaining at random the moves of the object piece from one of the smaller areas to another one of the smaller areas;

visually distinguishable indicia on said playing area to direct in accordance with the game rules the movement of said object piece from one of said smaller areas to a randomly-selected other one of said smaller areas in response to said second move determining means;

a first set of playing card means having indicia thereon for game playing purposes according to the game rules;

indicia on said game board for designating according to the game rules the taking by a player of one of said first playing card means when player pieces are moved thereto; and a second set of playing card means including pairs of playing cards, each one of said pairs including a card having on its face object-piece action indicia and a card having a blank face, said object-piece indicia designating object-piece action determined by the first playing card means taken by the players in accordance with the game rules and said blank faces designating object-piece non-action in accordance with the game rules so that each one of the players of the game may use at least one object-piece action indicia bearing card and at least one non-action blank card.

2. Game apparatus according to claim 1, wherein said first playing card means include playing cards arranged in a plurality of decks, different indicia being provided on each playing card, deck determining indicia on other ones of said subdivisions of the board designating in accordance with the game rules cards to be removed by players from said decks by the plays in accordance with said pieces being moved to said other ones of said subdivisions.

3. Game apparatus according to claim 2, wherein said indicia on said cards are weapon indicia, and money indicia.

4. Game apparatus according to claim 3, further including alibi bearing indicia on one of said decks of cards to designate in accordance with the game rules certain ones of said smaller areas, randomly arranged alibi deck designating indicia on said subdivisions to designate in accordance with the game rules the deck of cards bearing the alibi indicia to be taken by the player whose player piece is moved thereto.

5. Game apparatus according to claim 4, wherein said playing area is in the shape of a map of a country, further including city designating indicia on said smaller areas.

6. Game apparatus according to claim 5, further including plot charts having indicia for enabling the players according to the game rules to mark thereon information regarding player and object piece moves and cards taken by players, and a master chart having information indicia for designating according to the game rules object piece action as required by the game rules.

7. Game apparatus according to claim 1, further including means defining question mark indicia on certain ones of said subdivisions for designating according to the game rules the right of a player to ask questions of other players.

8. Game apparatus according to claim 1, wherein said first determining means includes dice means and said second determining means includes a randomly shuffled deck of cards, each card of which bears on its face an indicia representing one of said smaller areas.

* * * * *